US005735107A

United States Patent [19]

Vollenweider et al.

[11] Patent Number: 5,735,107

[45] Date of Patent: Apr. 7, 1998

[54] METHOD AND DEVICE FOR PRODUCING SAMPLE BAGS AND SAMPLE BAGS PRODUCED ACCORDING TO THE METHOD

[75] Inventors: Jürg Vollenweider, Fehraltdorf; Erich Jäger, Frauenfeld; Werner Heuberger, Bäretswil, all of Switzerland

[73] Assignee: Ferag AG, Hinwil, Switzerland

[21] Appl. No.: 638,996

[22] Filed: Apr. 24, 1996

[30] Foreign Application Priority Data

| | | | |
|---|---|---|---|
| Apr. 24, 1995 | [CH] | Switzerland | 01 167/95 |
| Jan. 29, 1996 | [CH] | Switzerland | 00 216/96 |

[51] Int. Cl.[6] ..... B65B 09/00

[52] U.S. Cl. ..... 53/450; 53/451; 53/550; 53/551; 53/375.2

[58] Field of Search ..... 53/450, 451, 455, 53/550, 551, 552, 553, 554, 555, 526, 527, 375.7, 375.5, 375.2, 374.7; 383/107, 108, 109, 110; 206/484, 521

[56] References Cited

U.S. PATENT DOCUMENTS

| | | | |
|---|---|---|---|
| 2,442,936 | 6/1948 | Rohdin | 383/108 |
| 2,444,685 | 7/1948 | Waters | 383/108 |
| 2,673,495 | 3/1954 | Hecker et al. | 383/107 |
| 2,737,339 | 3/1956 | Doyle | 383/107 |
| 3,471,990 | 10/1969 | Bonuchi et al. | 53/22 |
| 3,939,972 | 2/1976 | Mayworm | 383/107 |
| 4,324,088 | 4/1982 | Yamashita et al. | 53/527 |
| 5,031,386 | 7/1991 | Schieder | 53/551 |
| 5,155,980 | 10/1992 | Mansson et al. | 53/551 |
| 5,241,804 | 9/1993 | Tsuruta et al. | 53/526 |

FOREIGN PATENT DOCUMENTS

| | | |
|---|---|---|
| 1 123 612 | 10/1958 | Germany . |
| 1 271 012 | 6/1968 | Germany . |
| 24 49 570 | 4/1976 | Germany . |
| 2 124 580 | 2/1984 | United Kingdom . |
| WO 86/03163 | 6/1986 | WIPO . |
| WO86/05163 | 9/1986 | WIPO . |

*Primary Examiner*—John Sipos
*Assistant Examiner*—Gene L. Kim
*Attorney, Agent, or Firm*—Walter C. Farley

[57] ABSTRACT

Sample bags are produced from webs of film material by forming longitudinal seams and longitudinally spaced transverse seams and by filling the bags with a sample product between forming the transverse seams. In order to make the bags easier to handle, the longitudinal seams are thickened so that the thickness of the seams is equal to the thickness of the center of the bag. Thickening is done by rolling or folding the seams or by adding frames or strips of additional material either between or outside the seam portions of the webs. The resulting bags are more easily stacked, handled and inserted into publications for distribution.

11 Claims, 8 Drawing Sheets

STATE OF THE ART

METHOD AND DEVICE FOR PRODUCING SAMPLE BAGS AND SAMPLE BAGS PRODUCED ACCORDING TO THE METHOD

FIELD OF THE INVENTION

The invention is in the field of the packaging industry and relates to a method which serves for producing sample bags. The invention also relates to a device for carrying out the method and to sample bags produced according to the method. The produced sample bags contain fluid or solid samples and are especially suitable for an automated further processing with a high processing speed, e.g. for attaching them to or inserting them into printed products.

BACKGROUND OF THE INVENTION

The inserting, collecting, collating etc. of additional printed items into printed products, especially into periodicals (e.g. newspapers, magazines, brochures, prospectuses, also books etc.) has been expanded to other supplements to be combined with a primed product. Supplements in form of sample bags which contain solid items, e.g. cleansing towels or fluid samples, e.g. cream, paste, liquids, etc. are very popular. The bags normally consist of two blanks of a packaging material mostly of a multilayer plastic or paper film, which blanks are connected with each other along all their edges.

Techniques for handling printed products, e.g. cards, as supplements are known and fairly well developed. The mechanical means are available, and high speeds, adapted to the complete process can be achieved. The handling of sample bags, in the largest sense of the word, however causes a new range of problems. Sample bags generally do not have a defined form. They can have the form of cushions thus not being flat as desired and often not even being outwardly cambered in the same places. If the contents are fluid the form of the bag changes each time it is handled. Furthermore the handling is even more difficult because the sample bags are usually made of a plastic with a smooth, sliding surface such that friction which is normally helpful for stacking is very small. Stacks or bundles of sample bags are not stable and thus critical to be processed, especially with high processing speeds.

SUMMARY OF THE INVENTION

Such problems are solved by the invention. The greatest drawback for handling the sample bags in a process where they are inserted into printed products is found to be their form which is very unsuitable for forming stacks or bundles and which is in many cases not stable, i.e. the bag changes its form when handled. It is therefore the object of the invention to give the sample bags a stabilized form which is as flat as possible and which allows a desirable handling of the sample bags, by using, for producing the bags a method which is modified compared to the method according to the state of the art. By stabilizing the bag, changing of form by shifting of the contents when being manipulated is to be prevented as far as possible. Furthermore a cushion form of the bag is to be omitted or its influence on the forming of stacks or bundles to be restricted by further shaping means.

While the bag is being produced, the filled sample bags are conditioned for a following processing, in that, for stabilizing the form of the bags, additional shaping steps are introduced into the production method and/or additional forming elements are supplied into the production method.

The additional steps for stabilizing the form are integrated into the production method such that they only fractionally add to the expense of the method. Normally the stabilizing of form in the production of the sample bags does not result in a loss of speed. Regarding tools additional expenses are possible, but these are insignificant compared to the advantages achieved.

The sample bags produced according to the invention can be handled individually or as a web much more easily than known sample bags because they have a Stabilized form, i.e. a form which does not change substantially when handled and which is as flat as possible. For this reason they can be stacked to stacks or bundles, they can be gripped individually and they can be further processed without problems, in particular at high processing speeds. Inside the printed product the sample bag thus flattened does not add unnecessarily to the thickness of the printed product which means that more of such perfected sample bags can be integrated than before.

BRIEF DESCRIPTION OF THE DRAWINGS

A few preferred variants of the method according to the invention and sample bags produced with these are discussed in connection with the following figures.

DESCRIPTION OF THE PREFERRED EMBODIMENTS

Figure 1:
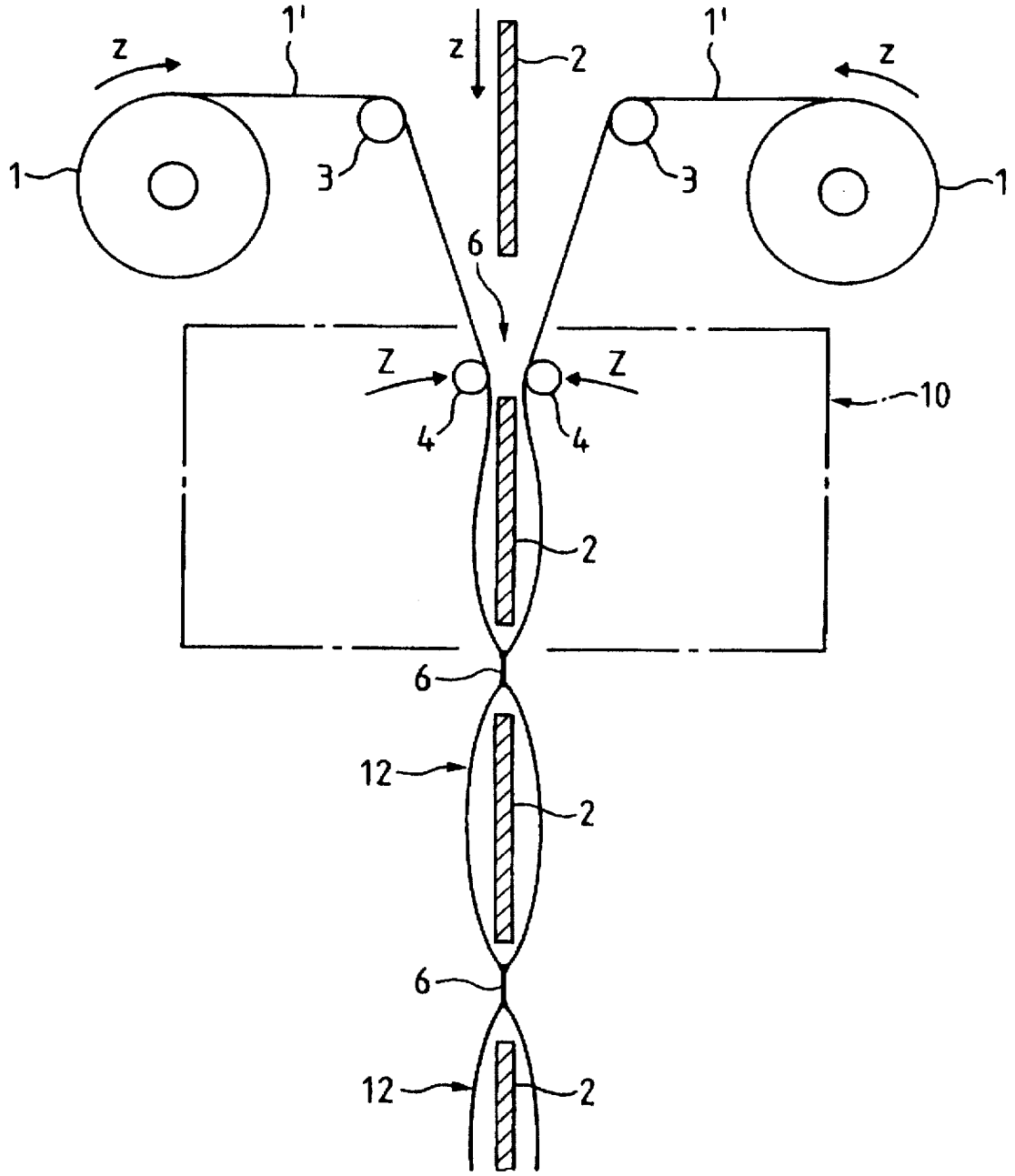
FIG. 1 PRIOR ART
FIG. 1 shows an installation for producing and filling sample bags according to the state of the art.

FIG. 1 shows in a very diagrammatic manner an installation according to the state of the art for packaging sample products into bags. The principle of the packaging process is known: from rolls 1 webs of foil 1' with e.g. a meltable coating are drawn in the direction of arrow z (z indicates the processing direction of the product) over deflection rollers 3 into a packaging part 10 of the installation, where a sample product 2 is enveloped with the foil material. In this part 10 of the installation the webs of film are closed to bags by forming continuous longitudinal seams and equidistant transverse seams 6, whereby the bags being produced are filled with a solid item 2 between the forming of successive transverse seams 6. As the sealing step is known, it is merely shown in a sketched manner, i.e. only the sealing elements, e.g. heating elements, for forming the transverse seams 6 of bags 12 are shown and their closing direction Z (Z indicates movement of parts of the device). The sealing elements for sealing the longitudinal seams are not shown.

The sample bags 12 which exit part 10 of the installation in form of a quasi endless web of bags are then normally separated from each other in the area of the transverse seams 6. The finished sample bags 12 typically have the form of cushions.

Figure 2:
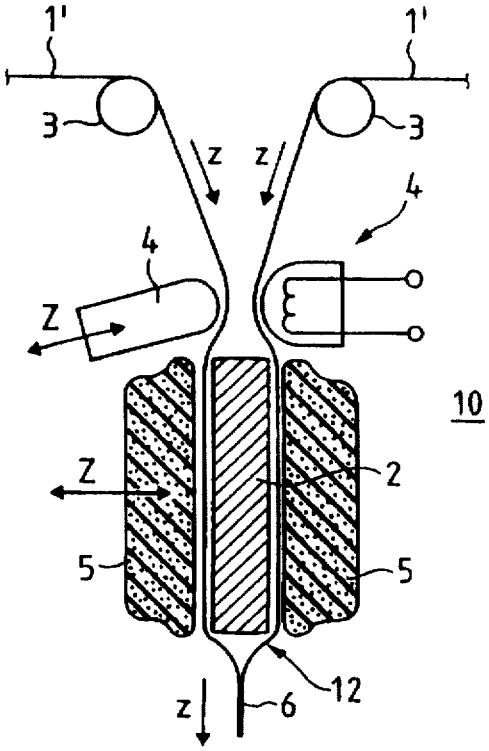
FIGS. 2 and 2*a* show, as an exemplified variant of the method according to the invention, an installation for producing and filling sample bags with a device for integrated stabilizing of the bag form by pressing out air (FIG. 2) and a sample bag with a stabilized form produced by such an installation in section (FIG. 2*a*).
Figure 2A:
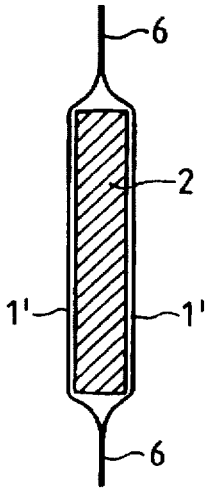

FIGS. 2 and 2*a* illustrate a first embodiment of the method according to the invention and the corresponding product. According to this variant of the method, as an additional shaping measure, as much air as possible is pressed out of the bag before it is sealed (forming of transverse seam 6 after filling). Experiments with bags containing each a moist tissue as an example of a solid sample product, have shown that by pressing air out of the bag astonishingly good results concerning the given object are achieved.

FIG. 2 shows an installation for carrying out the named method variant in the same manner as FIG. 1 (same reference numerals for already described parts). The pressing is done stepwise by means of soft pressing elements 5, e.g. polyurethane cushions, substantially moveable to-and-fro in direction Z which bring the bag into the desired form by pressing out superfluous gas. The pressing elements 5 are e.g. as shown, a moveable cushion and a corresponding counter-surface or two cushions moveable towards each other. The pressing elements 5 are arranged in the same part of the installation as the welding head 4 for sealing the transverse seams.

The pressed and welded sample bags, as shown in FIG. 2*a*, are rigid in a certain sense, keep their form and, on handling behave much more like a flat sample product than sample bags produced in known manner (FIGS. 1*a*) which are soft and have the form of a cushions. The solidity achieved with the method according to the invention is exactly the thing that was aimed for making possible handling possibilities in a following processing step which are conditions to high processing speeds.

Figure 3:
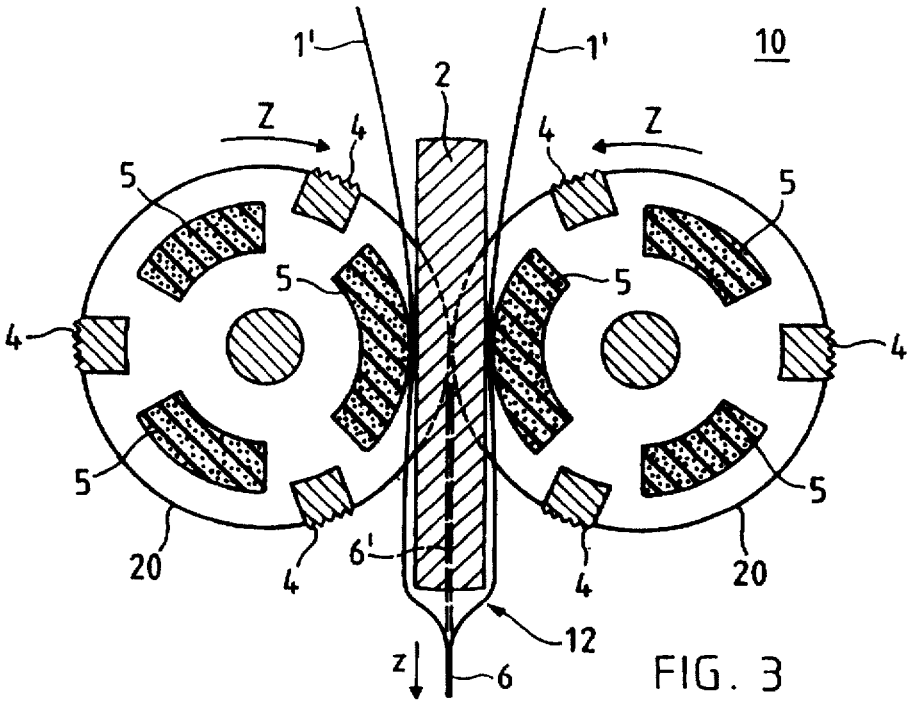
FIG. 3 shows a further device for stabilizing the form of the sample bag by pressing out air.

FIG. 3 shows in the same way as FIG. 2, an installation part 10 for continuously stabilizing the form of bags with solid contents by pressing out air. The sealing elements 20 for the longitudinal seam and the sealing elements 4 for the transverse seam as well as the pressing elements 5 for stabilizing the form of the bags are integrated in two cylinders or forming molds respectively between which the chamber for accepting the product sample is formed by means of a longitudinal seam 6', between which the pressing out of the superfluous gas is carried out and between which the transverse sealing seam 6 is finally formed. The pressing elements 5 consist of a soft, flexible material which does not damage the sample product 2 in the sample bag when pressing. By an opposed sense of rotation of the cylinders according to arrows Z the partially enveloped sample product is conveyed in direction z, is simultaneously enclosed by the longitudinal seams, conditioned (form-stabilized) and then sealed by means of a transverse seam. The transverse fins 4 (sealing elements) running in axial direction of the cylinders serve for this purpose. It is not defined here whether the sealing is achieved by the forming of ribs or by welding or in a different manner.

Figure 4:
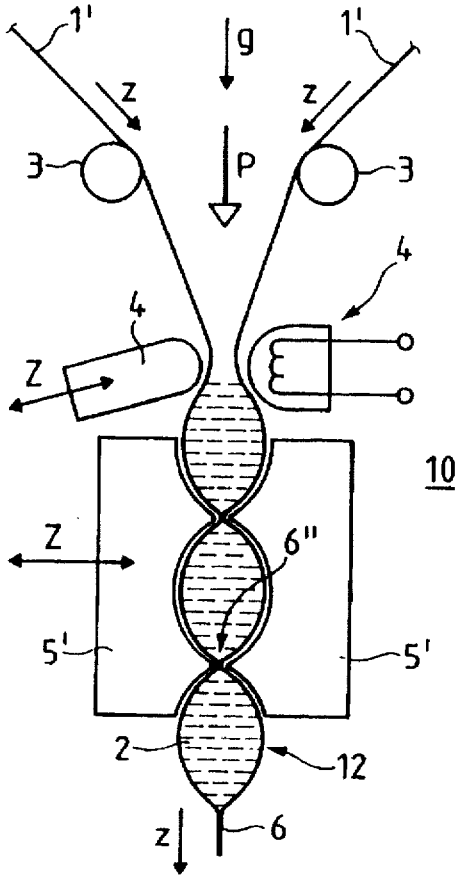
FIGS. 4, 4*a* and 4*b* show, as a further embodiment of the method according to the invention, an installation for producing and filling sample bags with a device for stabilizing the form of the bags by joining the bag material in specific locations within the bag chamber (FIG. 4) and two embodiments of sample bags produced in such an installation (FIGS. 4*a* and 4*b*).
Figure 4B:
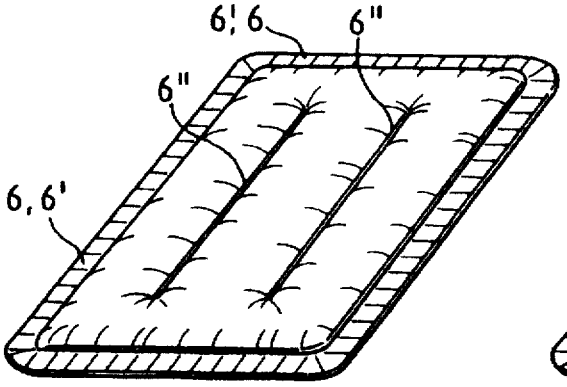
Figure 4A:
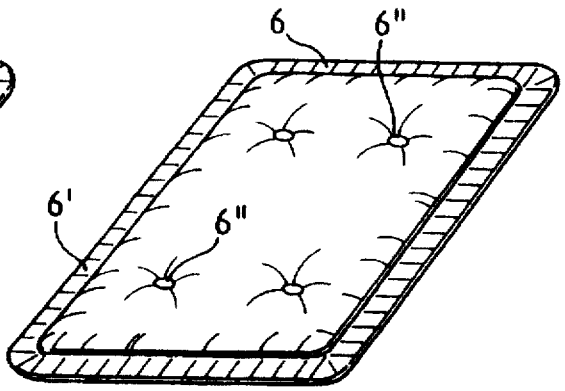

FIGS. 4, 4*a* and 4*b* again show a variant of the method according to the invention and the corresponding product by showing an installation very diagrammatically. In this variant, which is especially suitable for fluid sample products, the stabilization of form is achieved by producing joined locations in the chamber of the bag which contains the product in which joined locations the two webs 1' of film material are joined together in a similar way as in the area of the seams.

Experiments with bags with creamy contents show that by forming a system of chambers (joined lines), which do not impede the emptying of the bag but support it, similarly satisfying results can be achieved for the further processing of the bags. Depending on the dimensions of the bag several chambers are imprinted which all discharge into a main chamber which again discharges into the outlet of the bag. Another tried method for stabilizing is to at least impede shifting of the contents when handled by producing punctual joined locations. After such measures the contents can no longer collect in one area and thus no longer form irregular cushion-forms.

The joined locations are produced by means of either cycled pressing or by roll pressing. The joined locations, punctual or linear in form, do not need the same stability as the seams around the circumference of the sample bag or of the sample product respectively. Sample bags produced thus are "flat" in any position. As small leaks between the individual chambers do not influence the desired properties of the bag the following handling is not critical. A mere punctual fixing with only a few joined points to form "upholstery-like" recesses prevents the bag from becoming cushion formed.

The joining is e.g. carried out on the finished sample bag, whereby heat cannot be applied in all cases. Filling a sample bag with a fluid sample product may also be carried out by means of a reversible hollow needle after producing the joined points.

FIG. 4 shows an installation for producing the above described bag with fluid contents and stabilized by joined locations. Importance is attached to showing that stabilizing is again realized by means of pressing elements 5' which elements are very similar for fluid as well as for solid bag contents (pressing elements 5 in FIG. 2). The pressing elements for forming joined locations (when contents are fluid) are, depending on the method used for joining the inner surfaces of the bags, equipped for additionally applying e.g. heat or ultrasonics. Such a solution is very suitable when known filling machines are used. For this reason and intentionally FIGS. 2 and 4 (or 3 and 5 respectively) regarding bag production in a cycled operation (or in continuous operation respectively) are very similar. The pressing element 5 or 5' is varied according to the measure of stabilizing: once it is a cushion for pressing out superfluous gas then again it is a forming mold for forming joined locations.

The filling in of a fluid sample product P takes place in the installation according to FIG. 4 in the direction of gravity g. Obviously other filling methods which are not dependant on position, e.g. injecting through hollow needles may be used also.

FIGS. 4*a* and 4*b* show sample bags, produceable in an installation according to FIG. 4, which bags are stabilized by joined locations between the two film blanks. The sample bag according to FIG. 4*a* comprises 4 joined points 6" which give the bag a more or less flat form by the fact that they define the distance between the webs of film material forming the chamber to be filled. FIG. 4*b* shows a bag with fluid contents which are distributed into two parallel chambers by joined lines 6" which chambers open into a common area. The joined lines 6" run parallel to sealing seam 6.

Sample bags according to FIG. 4*b*, in which the joined lines 6" extending parallel to the longitudinal seams 6' can be produced with pressing elements, as they are shown in FIGS. 2 and 3, which pressing elements are to be adapted regarding shape and function.

Figure 5:
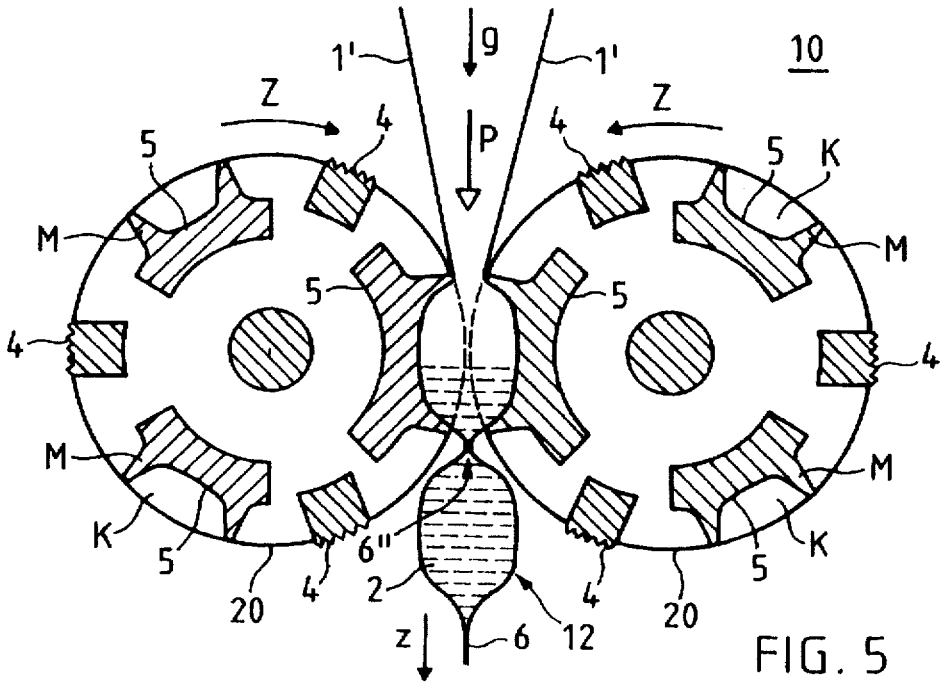
FIG. 5 shows a further device for stabilizing the form of the sample bags by producing joined locations.

FIG. 5 shows an installation part 10 for continuous conditioning of sample bags with fluid contents by equipping them with joined locations. Sealing elements 20 for the longitudinal sealing seams and sealing elements 4 for the transverse sealing seams as well as pressing elements 5 for the stabilizing or the forming of chambers in the bags respectively are integrated into two cylinders or form molds respectively between which the chamber for the sample product is formed by means of longitudinal seams. Pressing elements 5 are formed such that either joined lines 6" (FIG. 4*b*) or joined points 6" (FIG. 4*a*) are formed. Pressing elements 5 for conditioning consist of chambers K into which the bag to be conditioned can expand and of means M with which the joined locations are formed. By an opposed direction of rotation of the cylinders according to arrows Z the partially enveloped sample product is conveyed in the direction of arrow z, simultaneously sealed longitudinally, conditioned and then sealed completely with a transverse seam. The transverse fins 4 serve this purpose. Here again it is not defined whether the seams and the joined locations are formed by forming ribs or by welding or in a different manner. The filling with a fluid sample product P is e.g. carried out in the direction of gravity g, as is also shown in FIG. 3. Here the fluid sample product can also be injected with hollow needles simultaneously to the forming of the joined locations.

Figure 6:
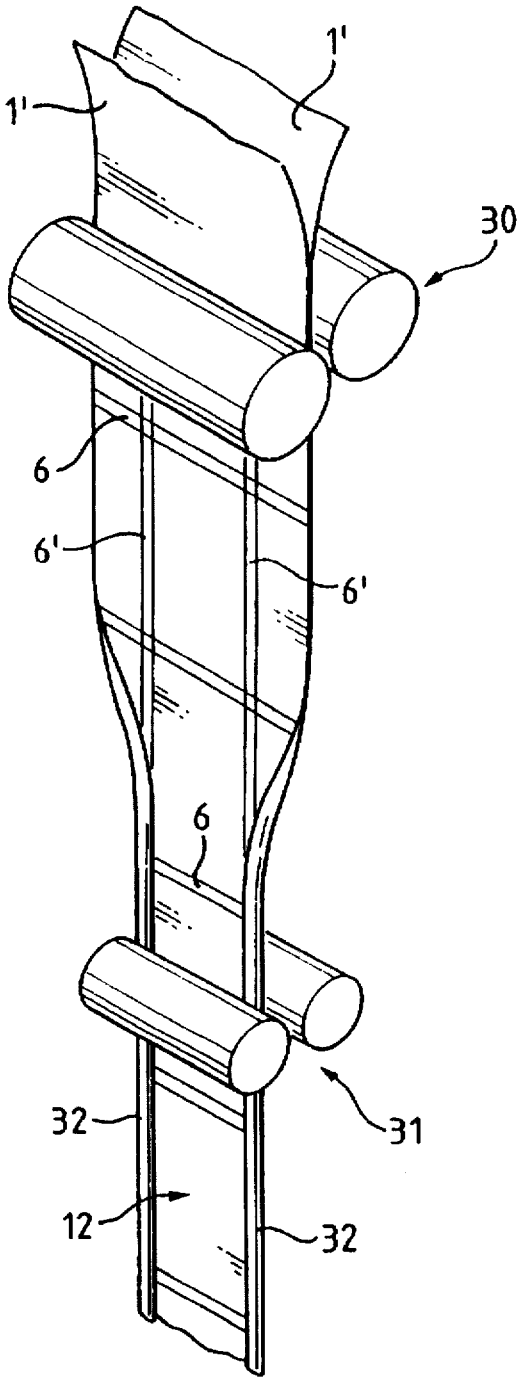
FIGS. 6 and 6*a* show, as a further embodiment of the method according to the invention, an installation for producing and filling sample bags with a device for stabilizing the form of the bags by reforming (FIG. 6) and a sample bag produced in such an installation in section (FIG. 6*a*).
Figure 6A:
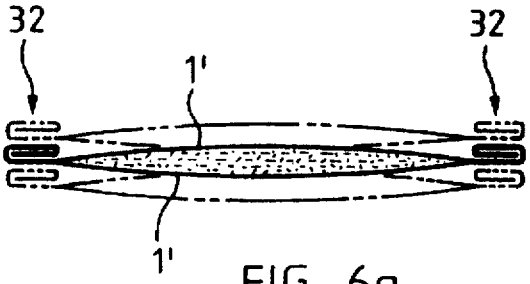

FIGS. 6 and 6*a* show a further embodiment of the method according to the invention and the corresponding product. In this variant of the method the sample bags are, after sealing but still as a quasi endless web of bags, further formed by rolling or folding in and pressing the longitudinal edges. FIG. 6 again shows a part of the installation very diagrammatically which installation part comprises a pair of cylinders 30 (e.g. in analogy to the pairs of cylinders of FIGS. 3 and 5 but without pressing elements 5 or 5') for forming longitudinal seams 6' and transverse seams 6. In this case the longitudinal seams 6' are not positioned at the very edges of the film material but at a distance from these or they have a correspondingly greater width. Immediately after the forming of the web of bags the longitudinal edges of the web are rolled or folded in by corresponding guiding elements (not shown) and then pressed in this position e.g. by a further pair of cylinders 31, possibly welded and thus stabilized in this position. The rolled or folded in longitudinal edges 32 of the web of bags can also be stabilized by other means, e.g. by applying an adhesive before rolling in and by pressing afterwards.

FIG. 6*a* shows a sample bag produced in the installation according to FIG. 6 in section parallel to the transverse seams 6. The Figure further shows with broken lines identical sample bags arranged in a stack. This stack shows that the areas of the longitudinal edges 32 formed by rolling or folding in and stabilized by pressing, welding and/or gluing have the function of fins by which the form of the bag, which is still substantially the form of a cushion, no longer prevents the bags from being stackable in a stable manner. Furthermore the edge areas 32 stabilize the form of the bag through their increased stiffness.

Figure 7:
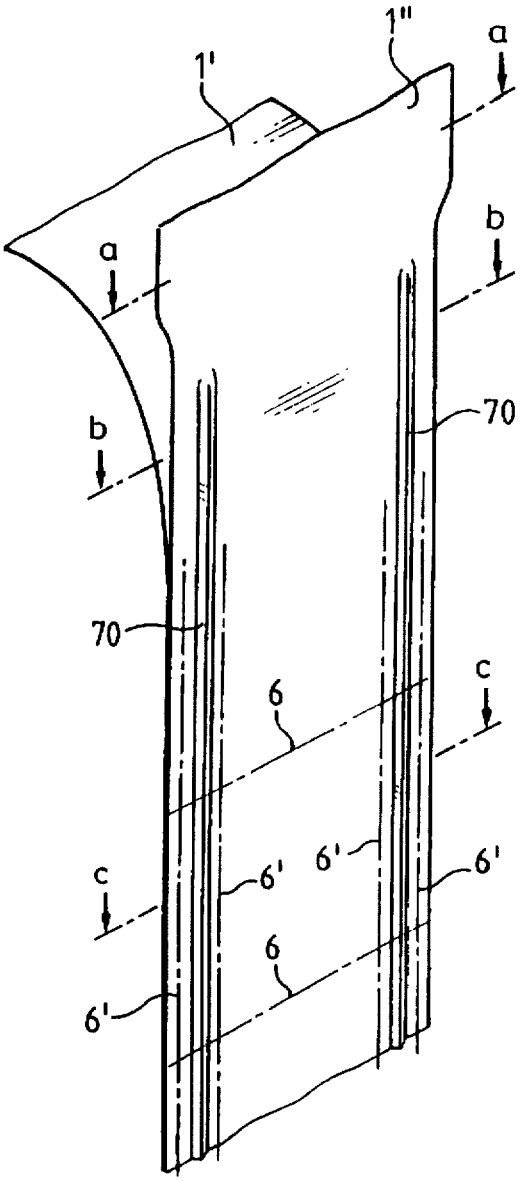
FIGS. 7 and 7*a* to 7*c* show a further embodiment of the method according to the invention with stabilizing of form by an additional forming step, shown by means of a three-dimensional illustration of the two webs of film material which run through the method (FIG. 7) and correspondingly formed products in section (FIGS. 7*a* to 7*c*).
Figure 7A:
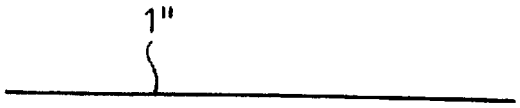
Figure 7B:
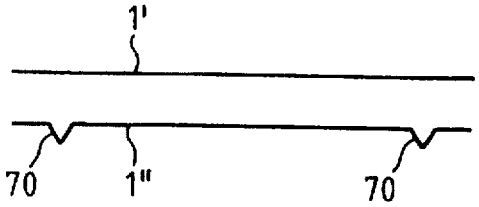

FIGS. 7 and 7*a* to 7*c* show a further embodiment of the method according to the invention which variant, compared to the method of production according to the state of the art, again comprises an additional forming step. In this method step a fold 70 in form of a ridge is formed with corresponding folding tools (not shown) on each side of one (1") of the webs of film material (FIG. 7*a*), i.e. before sealing the longitudinal seams 6', for each ridge three folding lines with alternating folding direction are formed parallel to the longitudinal edge of the web of film material. The web 1" with folds 70 is then further conveyed such that by corresponding reduction of its width the folds are given the desired height (FIG. 7*b*). Thus guided the web 1" is brought together with the other web 1' and longitudinal seams are formed as double seams on both sides of folds 70 (shown with two broken lines on each side of the fold lines). Then the bags are filled and the transverse seams are formed.

Figure 7C:
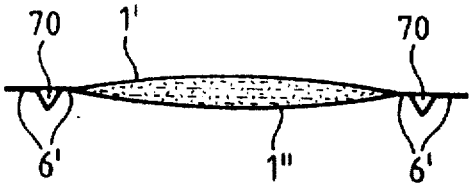

A section parallel to the transverse seams of a finished sample bag is shown in FIG. 7*c*. It is obvious that the folds 70 fixed by the double longitudinal seams 6' have the same function as the thickened edge areas of the bags according to FIG. 6*a*. A possibly significant difference to the embodiment according to FIG. 6*a* is that folds 70, after manipulation which they facilitate or make at all possible, may be flattened easily and then only increase the thickness of the bag to a very low degree. In other words, sample bags according to FIG. 7*c* can safely and without problems e.g. be inserted into printed products at high processing speeds thanks to the stabilizing effect of folds 70. Just as easily folds 70 can be flattened when the bag is being fixed on or in a printed product or later by means of pressing, whereby the bag then only minimally increases the thickness of the printed product.

Variants of the method according to FIGS. 7 and 7*a* to 7*c* can comprise that one or two folds are formed on each of the two webs of film material and that the folds do not have the form of ridges (not have a triangular cross section) but have a cross section in form of the segment of a circle or a trapezoid. The original width of the two webs of film can be identical or adapted to each other such that the longitudinal edges of the two webs match in the finished bag.

Figure 8:
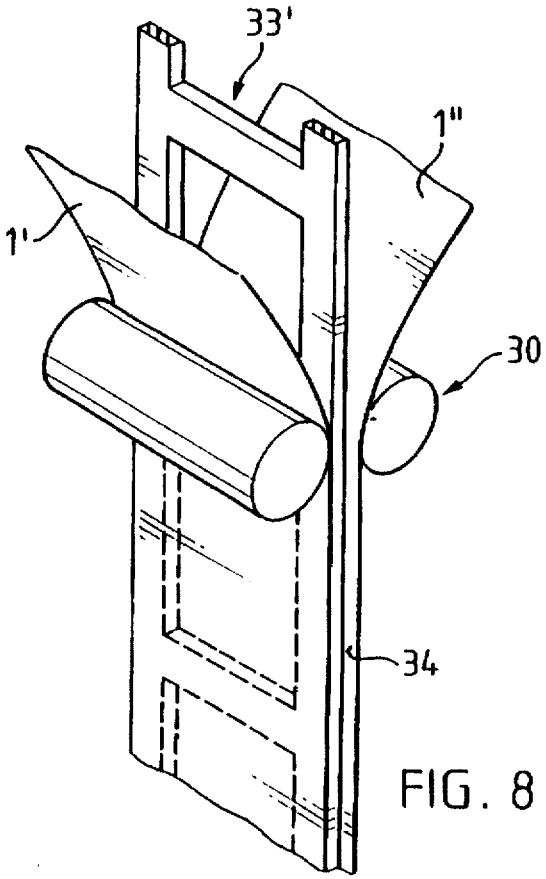
FIGS. 8 and 8*a* show, as a further embodiment of the method according to the invention, an installation for producing and filling sample bags whose form is stabilized by integration of an additional forming element (FIG. 7) and a sample bag produced in such an installation in section (FIG. 7*a*).
Figure 8A:
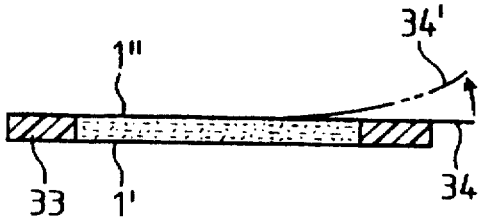

FIGS. 8 and 8*a* show a further embodiment of the inventive method and the corresponding product. The sample bags produced according to this variant are stabilized by an additional forming element. In this case the additional forming elements are frames 33, which are positioned between the webs of film material 1' and 1" as a quasi endless web of frames 33', which flames are fixed to the webs of film material when the longitudinal and transverse seams are made, and are separated from each other together with the bags. The flames 33 e.g. consist of plastic (solid or foamed) and have a thickness of e.g. 0.5 to 1 mm.

For the sample bags to be easily openable easily in spite of the frames, it is suggested to make the one web 1" of film material slightly wider than the other web 1' of film material such that the film material is not flush with the frame (area 34). Furthermore it is suggested that the materials of at least web 1" and of the frame are chosen such that, they form a peelable connection. FIG. 7*a* shows a sample bag with a frame 33 in section parallel to the transverse seams. The Figure also shows the peelable area of the film in a dosed and in an open (34') position.

Figure 9:
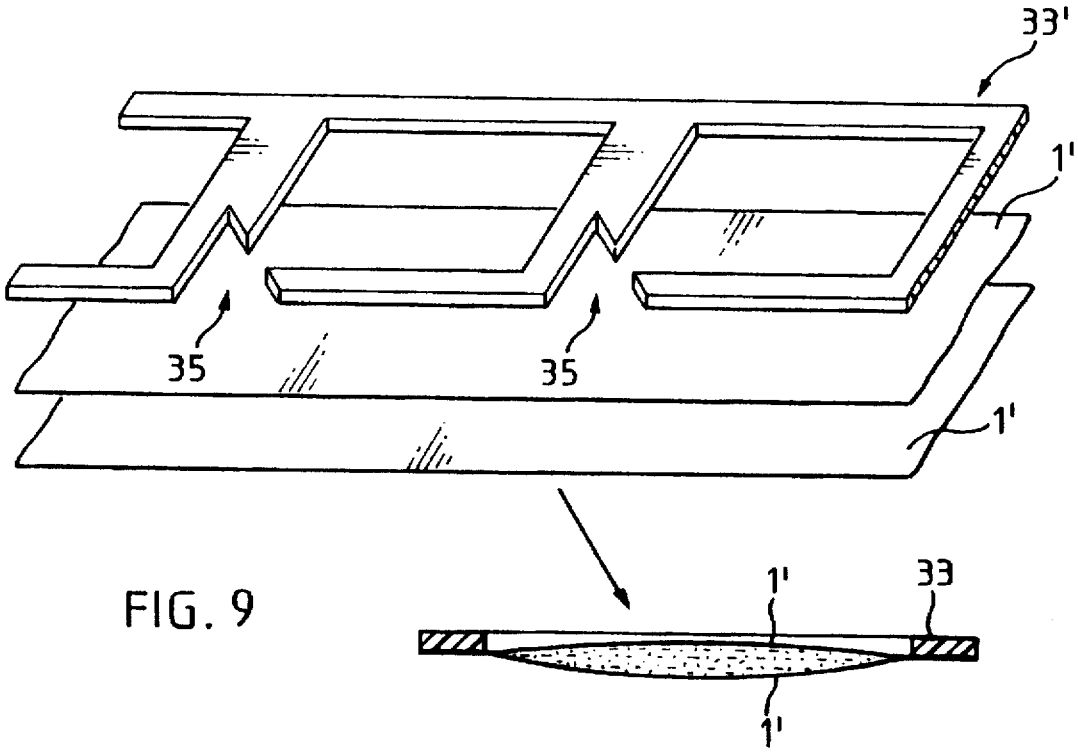

FIG. 9 shows a further embodiment of the inventive method and the corresponding product. The method is again based on two webs 1' of film material and a web 33' of frames, whereby the web of frames is not positioned between the webs of film material as in the method according to FIG. 8 but adjacent to the webs of film material.

For the sample bags according to FIG. 9 to be easily openable, frames 33 e.g. comprise gaps 35 in one corner. The webs 1' are e.g. equipped with perforations in the corresponding locations. Instead of the shown gaps 35 and the corresponding perforations, in analogy to the method according to FIG. 8, the web 1' facing away from the web of frames 33' can be chosen to be somewhat wider and to be connected to the other web of film material in a peelable connection. Such a sample bag is then openable in the same way as the sample bag of FIG. 8*a*.

Figure 10:
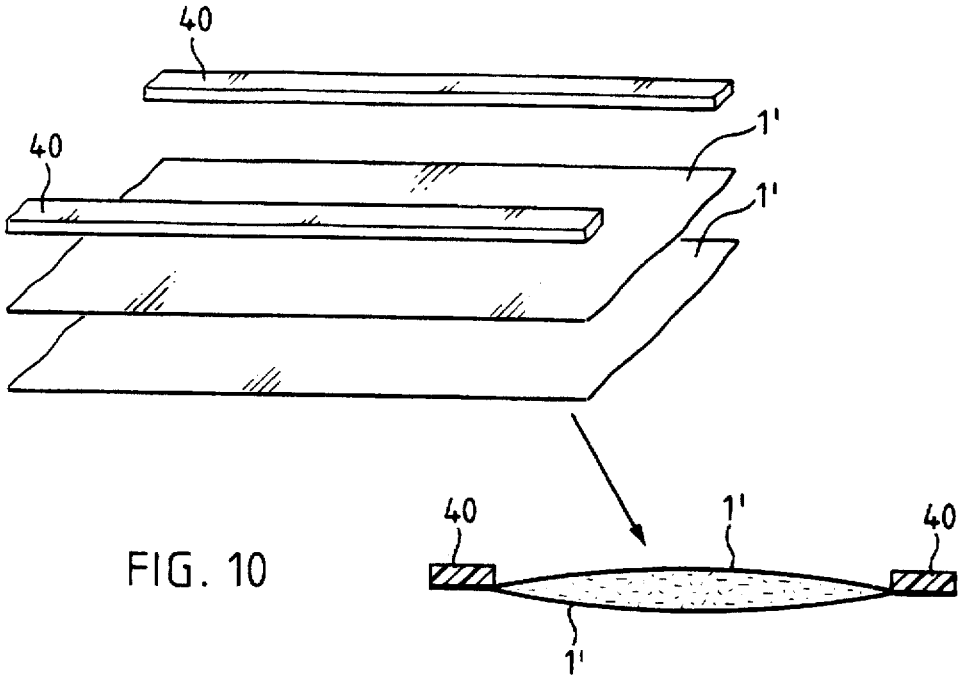

FIG. 10 shows a further embodiment of the inventive method and the product formed with this variant. As additional forming elements two strips 40 are introduced into the method before or after the forming of the longitudinal and transverse seams which strips are connected to one of the webs 1' of film material or with the web of sample bags in the area of the longitudinal seams, e.g. by welding or gluing. A direct extrusion of a suitable plastic onto one of the webs of film material or onto the web of sample bags is also possible. Obviously the strips can, in analogy to the method described in connection with FIGS. 8 and 8*a*, also be introduced between the two webs of film material 1' before the forming of the seams.

The strips 40 can be adapted in a wide spectrum to the used webs of film material, to the contents of the sample bags and/or to the production parameters in what regards material and texture of the material and in what regards cross section. They are strips made of cardboard, paper or plastic (solid or foamed) with any hollow or compact cross section.

Figure 12:
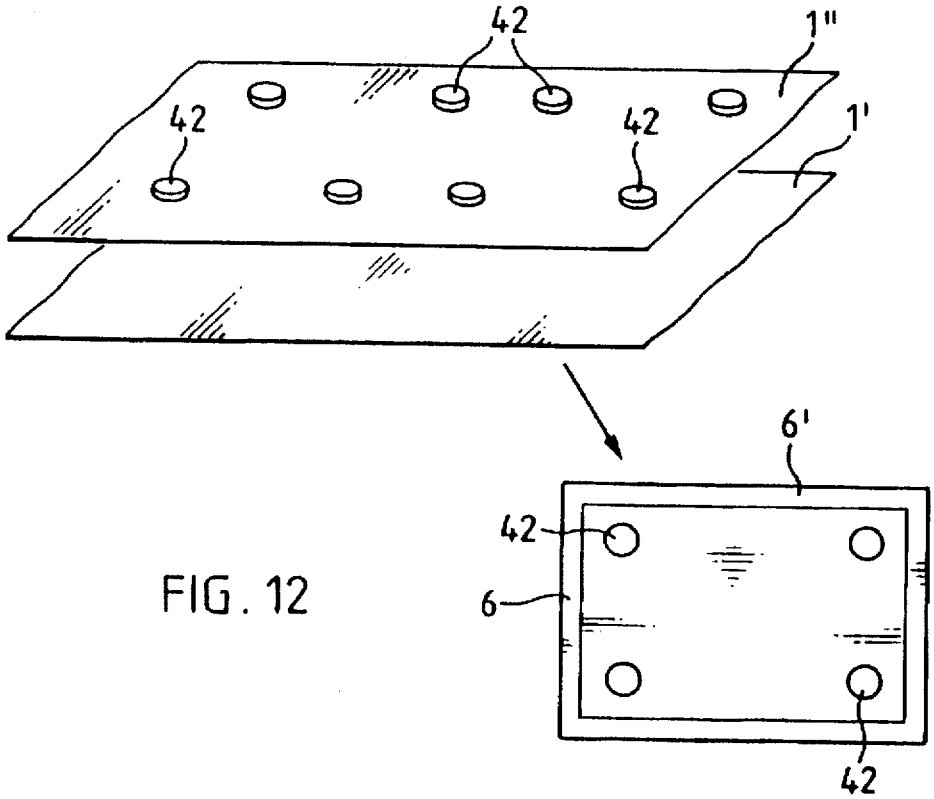
FIGS. 9 to 12 show various starting materials and sample bags with additional forming elements produced from these starting materials.
Figure 11:
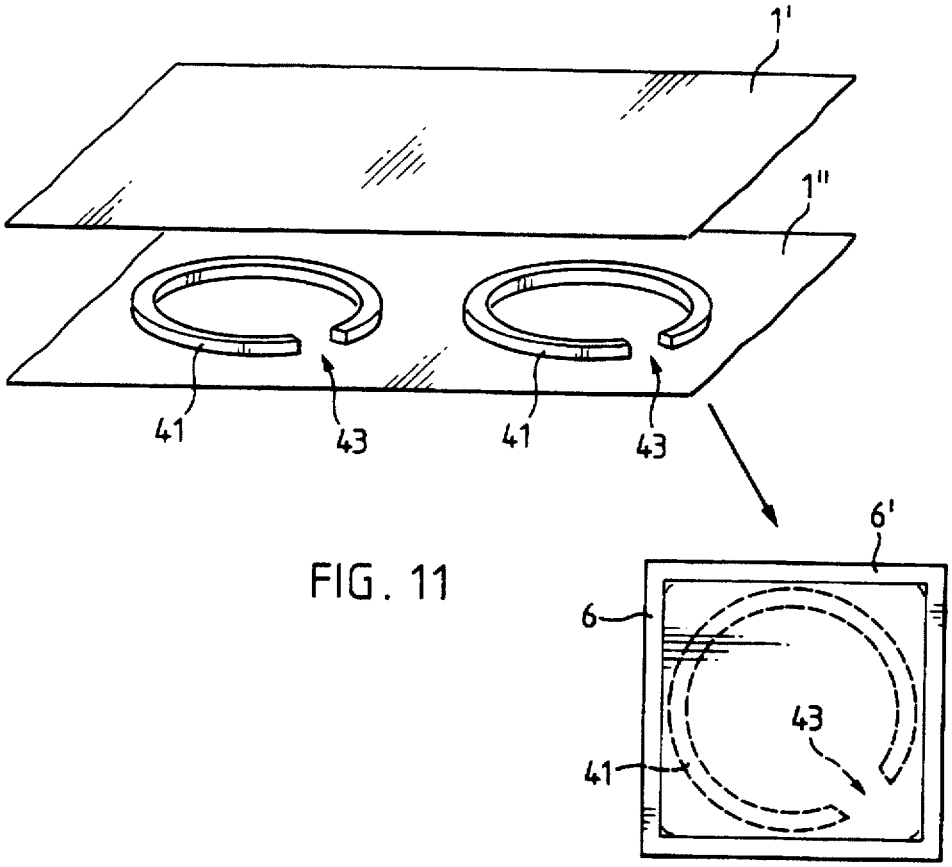

FIGS. 11 and 12 show embodiments of the inventive method and corresponding products in which the stabilizing of form is achieved by at least one individual forming element for every single sample bag. These forming elements are e.g. rings 41 introduced between the webs of film material 1' and 1" or supporting points 42 attached to one outer surface of the bag in the area of the comer of the bag. The forming elements are e.g. attached before the forming of the longitudinal and transverse seams by welding, gluing or similar connecting methods. The rings 41 as forming elements can comprise, as described for the frames (FIG. 9), e.g. gaps 43 for opening the sample bags.

We claim:

1. A method of producing filled sample bags comprising the steps of providing two webs of bag material having longitudinal edges, joining the longitudinal edges of the webs to form two longitudinal fin seams having a thickness, joining the webs along longitudinally spaced transverse lines to form transverse fin seams, introducing bag contents between the transverse fin seams to make filled sample bags each defined by two sequential transverse fin seams, each sample bag having a thickness determined by the nature and quantity of contents introduced between the transverse fin seams, and increasing the thickness of the longitudinal fin seams to a thickness substantially equal to the thickness of the filled sample bags, whereby the filled sample bags have improved handling characteristics.

2. A method according to claim 1 wherein the step of increasing the thickness of the longitudinal fin seams comprises folding the longitudinal fin seams until each longitudinal fin seam substantially equals the thickness of the filled sample bags.

3. A method according to claim 1 wherein the step of increasing the thickness of the longitudinal fin seams comprises rolling the longitudinal fin seams until each longitudinal fin seam substantially equals the thickness of the filled sample bags.

4. A method according to claim 1 wherein the step of increasing the thickness of the longitudinal fin seams comprises forming folds parallel to the longitudinal edges of at least one of the webs of bag material before joining the edges to form the longitudinal fin seams, and joining the webs along two parallel lines, one line on each side of each fold.

5. A method according to claim 1 wherein the step of increasing the thickness comprises inserting a thickness-forming element separate from the webs between the longitudinal edges of the webs, and joining the webs to the thickness-forming element.

6. A method according to claim 5 wherein said thickness-forming element comprises a longitudinal sequence of frames.

7. A method according to claim 5 wherein the thickness-forming element comprises pairs of longitudinally extending strips.

8. A method according to claim 1 wherein the step of increasing the thickness comprises adding thickness-forming elements separate from the webs to the longitudinal edges of the webs, and joining the thickness-forming elements to the joined longitudinal fin seams.

9. An apparatus for producing filled sample bags comprising means for delivering to a joining station two webs of bag material, each web having generally parallel longitudinal edges;

means at the joining station for joining said longitudinal edges of one web to said longitudinal edges of the other web to form two longitudinal fin seams;

means for joining said webs at longitudinally spaced locations transverse to said longitudinal edges to form a series of sample bags;

means for introducing contents into each said bag between pairs of transverse spaced locations;

means for separating said bags from each other to form a plurality of filled sample bags a central portion of each having a thicknesses determined by said contents; and means for increasing thicknesses of said longitudinally fin seams to a thickness at least substantially equal to said thickness of said central portion.

10. An apparatus according to claim 9 wherein said means for increasing includes means for rolling said fin seams upon themselves to increase the thicknesses of said seams.

11. An apparatus according to claim 9 wherein said means for increasing includes means for folding said fin seams upon themselves to increase the thicknesses of said seams.

* * * * *